US005612776A

United States Patent [19]

Machino et al.

[11] Patent Number: 5,612,776

[45] Date of Patent: Mar. 18, 1997

[54] RECORDING APPARATUS AND METHOD WITH SHEET FEED CONTROL THAT CONTROLS LOOP

[75] Inventors: Hitoshi Machino, Yokohama; Hiroshi Hashimoto; Soya Endo, both of Tokyo; Tomohiro Nakamori, Ichikawa; Masanori Ishizu, Tokyo; Junichi Kimizuka, Yokohama, all of Japan

[73] Assignee: Canon Kabushiki Kaisha, Tokyo, Japan

[21] Appl. No.: 412,213

[22] Filed: Mar. 27, 1995

Related U.S. Application Data

[63] Continuation of Ser. No. 986,746, Dec. 8, 1992, abandoned.

[30] Foreign Application Priority Data

Dec. 10, 1991 [JP] Japan ..... 3-349886
Apr. 30, 1992 [JP] Japan ..... 4-135596

[51] Int. Cl.[6] ..... G03G 15/00; B65H 5/22; B65H 3/44

[52] U.S. Cl. ..... 399/43; 271/3.15; 271/3.16; 271/9.01

[58] Field of Search ..... 355/308, 309, 355/311, 316; 271/3.15, 3.16, 9.01

[56] References Cited

U.S. PATENT DOCUMENTS

| | | | |
|---|---|---|---|
| 4,214,833 | 7/1980 | Kono | 355/309 |
| 4,579,446 | 4/1986 | Fujino et al. | 355/24 |
| 4,664,503 | 5/1987 | Ibuchi | 355/311 |
| 4,676,499 | 6/1987 | Kimizuka et al. | 271/270 |
| 4,733,310 | 3/1988 | Kapp et al. | 355/311 X |
| 4,853,740 | 8/1989 | Ushio et al. | 355/319 |
| 4,868,609 | 9/1989 | Nagata et al. | 355/316 |
| 4,878,428 | 11/1989 | Watarai | 355/309 X |
| 4,937,622 | 6/1990 | Makiura | 355/316 X |
| 5,073,802 | 12/1991 | Sugiyama | 355/309 X |
| 5,136,342 | 8/1992 | Ida et al. | 355/316 X |
| 5,212,519 | 5/1993 | Kasahara et al. | 355/308 X |
| 5,221,949 | 6/1993 | Miyamoto | 355/309 |

*Primary Examiner*—Fred L. Braun
*Attorney, Agent, or Firm*—Fitzpatrick, Cella, Harper & Scinto

[57] ABSTRACT

When a recording medium fed from a sheet feed drive mechanism is detected at a predetermined position, the counting of a loop feed time or the like variably set in accordance with a predetermined sheet feed condition such as the sheet type or particular supplying device is started, and the drive of the sheet feed drive mechanism is controlled by terminating the feeding operation in accordance with a count termination state. A count time of a timer for detecting a feed jam is variably set in accordance with a sheet feed condition such as material of sheet.

44 Claims, 12 Drawing Sheets

DISCHARGE UNIT PAPER SENSOR
FIXING DEVICE
HIGH VOLTAGE CIRCUIT BLOCK
REGISTRATION ROLLER CLUTCH
PRE-REGISTRATION SENSOR
DISPLAY UNIT
INTERFACE UNIT
CPU
RAM
TIMER
TIMER
TIMER
LASER UNIT
1
1-a
1-b
1-c
1-d
2
3
4
5
6
7
8
9
10
11
12
13
14
15
16
17
18
19
20
21
22
23

FIG. 3

| CODE | FUNCTION |
|---|---|
| ⋮ | ⋮ |
| 4AH | PAPER FEED INDICATION OF OPTION CASSETTE |
| 4CH | PAPER FEED INDICATION OF STANDARD CASSETTE |
| 4FH | INDICATION OF MPT PAPER FEED |
| ⋮ | ⋮ |
| 9DH XXH | PAPER SIZE AND KIND INDICATION OF MPT PAPER FEED |
| ⋮ | ⋮ |

FIG. 4

| | |
|---|---|
| MSB | 0 |
| | MPT PAPER FEED PAPER SIZE · KIND ( CODE 6bit ) |
| LSB | PARITY (ODD) |

RECORDING APPARATUS AND METHOD WITH SHEET FEED CONTROL THAT CONTROLS LOOP

This application is a continuation of application Ser. No. 07/986,746 filed Dec. 8, 1992, now abandoned.

BACKGROUND OF THE INVENTION

1. Field of the Invention

The present invention relates to a recording apparatus having sheet feed means for feeding recording media of different materials or a recording apparatus having a plurality of different types of sheet feed means.

2. Related Background Art

A recording apparatus which draws a light signal representing an input image information onto a photoconductor to form an electrostatic latent image, develops the latent image, transfers it onto a record sheet which serves as a recording medium, fixes it and ejects the record sheet out of the apparatus has been widely used.

In such a recording apparatus, some control to register the fed record sheet to the image developed on the photoconductor is required. For example, the feed status of the record sheet fed from the sheet feed means is detected to control an image write timing to write the image to the photoconductor so that the image is properly transferred to the record sheet.

On the other hand, the content outputted by the recording apparatus is versatile. It includes simple document information, image information, graphic information and the like as well as information recorded on record sheets of different recording media materials such as address printing or post card printing. Accordingly, a recording apparatus having sheet feed means such as a cassette as well as a manual sheet feed mechanism has been put into practical use.

In such a recording apparatus, in order to correct a skew of the record sheet, the record sheet is flexed in a loop shape at a timing roller (for example, a registration roller) and then it is fed in an image transfer direction (loop feed method). In this case, if the record sheet is a cut sheet having a thickness which is comparable to that of a conventional copy sheet, no problem is presented, but if it is a thick record sheet such as an envelope which has a small freedom of deformation, the envelope 75 fed by a feed roller 71 shown in FIG. 15 which serves as the record sheet may be bent in a snake shape when it reaches a registration roller 74 through transport guides 72 and 73, depending on the shape of the feed path.

In a recording apparatus which has a plurality of sheet feed mechanisms and transports a record sheet to the registration roller 74 through different transport paths, the record sheet may be snaked or not snaked depending on the transport path.

Where the transport path is curved, a time for the sheet to reach the timing roller changes depending on the type of sheet. When the sheet is thick, the reach time is significantly long. Accordingly, the occurrence of jam cannot be exactly detected by uniform timer monitoring.

In such a recording apparatus, an output timing of a vertical synchronous signal of the image is used as a reference of various control timings, the following problems (1)–(4) are presented.

(1) Where a size of a record sheet is not known, for example, an undefined size of sheet is used, or a sheet cut by a user and longitudinal and lateral dimensions of which are not known is used, an end timing of the image recording control cannot be specified and stop timings to drive units cannot be precisely controlled. In a recording apparatus which uses a known electrographic process, if the control is made by assuming a size which is equal to a maximum print sheet size that the recording apparatus can handle, the image recording control continues even after a rear edge of the sheet has passed, and the inside of the apparatus is contaminated by the scatter of toner.

(2) Since it is necessary to continue the image recording control for the assumed length, a time to reach the end of image recording is unduely long. Similarly, automatic sheet ejection for a sheet remaining in the apparatus when the apparatus is powered on is also long. This is because the process time is unconditionally set to a time required from the start of the transport to the pass of the rear edge of the sheet through an exit of the transport path by assuming that a leading edge of the maximum sheet that can be handled by the apparatus is positioned at an entry of the sheet feed path.

(3) Not only the sheet ejection time and the stop time of the drive unit are long in the above control, but also a temperature in the apparatus rises by the drive (because a duty factor of clutches increases), and a lifetime of the apparatus is shortened and a load for maintenance increases. As an example, an affect to a stay jam process of a sheet at a predetermined position is explained.

The stay jam is detected when a sheet does not pass a predetermined point in the transport path at a time (within a certain margin) when the rear edge of the sheet is to pass that point. If the stay jam is detected based on the sheet transfer length of the maximum feedable sheet as described in (1) and (2) above, and if a sheet having a much shorter sheet transport length than the sheet transport length of the maximum feedable sheet is fed, the detection thereof is delayed and the sheet may be fed to a point where it is difficult to remove the sheet. Such sheet feed may damage the parts.

(4) Even if the transport length of the sheet is detectable, the time from the start of the feed to the arrival at the exit of the transport path varies by a slip of rollers of the sheet transport system and the reduction of the transport speed due to the reduction of diameters by abrasion. Thus, when the rear edge of the sheet reaches the exit, errors have been accumulated and a margin is reduced. As a result, it is not easy to set the timing to detect the stay jam at the exit of the transport path.

SUMMARY OF THE INVENTION

It is an object of the present invention to solve the above problems.

It is another object of the present invention to provide a recording apparatus which feeds a recording medium at an optimum condition without regard to material and size of the recording medium to be fed.

It is a further object of the present invention to provide a recording apparatus which can separately determine a stop timing of a feed drive system to a recording medium of any length and a stop timing to image recording process.

In the present invention, when detection means detects the recording medium fed from the sheet feed drive mechanism at the predetermined point, it starts the counting of a loop feed time which is variably set in accordance with a desired sheet feed condition, controls the drive of the feed drive mechanism in response to the end of counting to form an optimum loop in the recording medium in accordance with the sheet feed condition.

Setting means sets the loop feed time in accordance with the selection of a particular one of a plurality of sheet feed means. Thus, the optimum loop is formed in the recording medium without being affected by the construction of the transport path.

The setting means variably sets the loop feed time in accordance with a sheet material designation done by designation means and controls the drive of the feed drive mechanism in accordance with the end status of the counting so that the optimum loop is formed in the recording medium without being affected by the material of the record sheet.

When the feed of the recording medium is started by the drive of the feed drive mechanism, the counting of the variably set feed time is started, and detection means detects the presence or absence of feed jam in response to the end of the counting so that the feed jam can be detected at an optimum timing without being affected by the material of the recording medium.

The feed time is variably set to a timer in accordance with the feed mechanism selected by selection means and the presence or absence of the feed jam is detected at the end of the counting so that the feed jam can be detected at the optimum timing without being affected by the construction of the transport path.

The feed time is variably set in accordance with the material of the sheet and the presence or absence of the feed jam is detected at the end of the counting so that the feed jam can be detected at the optimum timing without being affected by the material of the recording medium.

When the passage of the recording medium fed from the feed drive mechanism through the predetermined point is detected by the detection means, counting is started to control a timing to terminate a record sequence in response to the elapse of the variably set count time so that the record sequence can be terminated at an optimum timing without being affected by the transport length of the recording medium and without imparting load or damage to the image recording system or the recording medium drive system.

When the passage of the recording medium through the predetermined point is detected, the counting is started and sheet ejection control means controls an automatic sheet ejection sequence of the recording medium in response to the elapse of the variably set count time so that the recording medium staying in the apparatus can be ejected at an optimum timing and automatic sheet ejection jam can be detected without being affected by the transport length of the recording medium.

Other objects and advantages of the present invention will be more apparent from the accompanying drawings, detailed description and claims.

BRIEF DESCRIPTION OF THE DRAWINGS

FIG. 3 shows an example of communication commands for a CPU shown in FIG. 1 and an external unit, FIG. 4 shows a bit configuration of the communication command in the recording apparatus of the present invention.

DETAILED DESCRIPTION OF THE PREFERRED EMBODIMENTS

Figure 1:
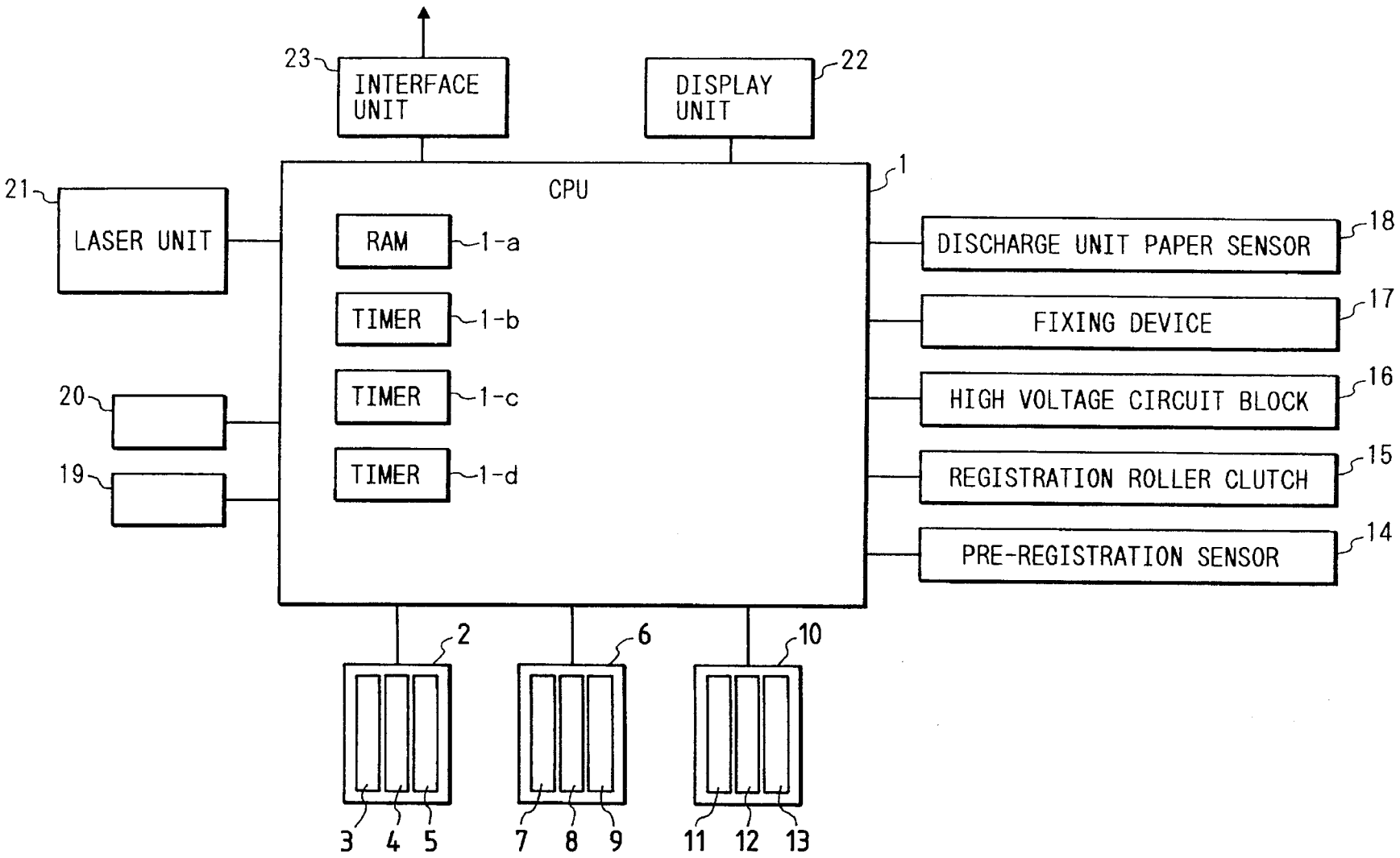
FIG. 1 shows a block diagram of a control configuration of a recording apparatus in accordance with one embodiment of the present invention.

FIG. 1 shows a block diagram of a control configuration of a recording apparatus in accordance with one embodiment of the present invention.

In FIG. 1, numeral 1 denotes a CPU which controls a print sequence of the apparatus in accordance with a control program stored in a ROM (not shown). Numeral 1-*a* denotes a RAM which functions as a work memory for the CPU 1. Numerals 1-*b*, 1-*c* and 1-*d* denote timers. Numeral 2 denotes an optional sheet (paper) feed mechanism (optional feeder) which is optionally connectable to the apparatus and comprises a cassette size detection switch 3, a sheet (paper) presence sensor 4, a clutch 5 for driving a feed sheet (paper) roller and the like.

Numeral 6 denotes a standard cassette sheet (paper) feed mechanism (standard cassette feeder) which comprises a cassette size detection switch 7, a sheet presence sensor 8, a clutch 9 for driving a feed roller and the like.

Numeral 10 denotes a multi-purpose sheet (paper) feed mechanism (multi-purpose feeder mechanism) which comprises a sheet presence sensor 11, a feed roller clutch 12, a feed plate lifter 13 and the like. Numeral 14 denotes a pre-registration sensor which detects when a record sheet fed from the sheet feed mechanism reaches a predetermined position and informs it to the CPU 1. Numeral 15 denotes a registration clutch which connects and disconnects the transmission of a driving power to a registration roller to be described later. Numeral 16 denotes a high voltage circuit block which applies a high voltage to a transfer charger (not shown) and the like. Numeral 17 denotes a fixer which comprises a hot roller and a pressure roller and fixes developer (toner) transferred to the record sheet fed through the transport path onto the record sheet. Numeral 18 denotes an ejection unit sheet sensor (discharge unit paper sensor) which monitors the ejection of the record sheet which has completed the fixing process and informs it to the CPU 1. Numeral 19 denotes a main motor which transmits a motive force to the feed/transport mechanism of the recording apparatus and the rollers of the process cartridge. Numeral 20 denotes a fan motor which drives a fan to cool the inside of the apparatus. Numeral 21 denotes a laser unit which comprises a semiconductor laser for emitting a laser beam for scanning a photoconductor, an fθ lens, a polygon mirror, a scanner motor, a controller and the like for controlling the drive thereof (horizontal print control, laser power control). Numeral 22 denotes a display unit which displays a printer status to an operator. Numeral 23 denotes an interface unit which, together with an external unit (not shown), sends and receives commands, status, printer control signal and image signal.

In the recording apparatus thus configured, when detection means (the pre-registration sensor in the present embodiment) detects a leading edge of the recording medium fed from the sheet feed drive mechanism (the optional sheet feed mechanism 2, the standard cassette sheet feed mechanism 6 and the multi-purpose sheet feed mechanism 10 in the present embodiment ) at a predetermined point, first setting means (by a functional processing of the CPU 1) starts the counting of a timer 1-*b* (which functions as a first timer) for counting a feed time variably set in accordance with a sheet feed condition, and control means (the CPU 1 in the present embodiment) controls the drive of the sheet feed mechanism in response to the end of the counting of the timer 1-*b* to enable the formation of a loop in the recording medium which is optimum to the sheet feed condition.

The first setting means variably sets to a timer a loop feed time which is counted by the timer 1-*b* in accordance with the selection of a sheet (paper) feed port by selection means (a command from a console or an external unit which are not shown) and control means (the CPU 1 in the present embodiment) controls the drive of the sheet feed drive mechanism in response to the end of the counting by the timer 1-*b* so that the optimum loop can be formed in the recording medium without being affected by the length of the transport path.

The first setting means (the CPU 1 in the present embodiment) variably sets the loop feed time which is counted by the timer 1-*b* in accordance with the paper material designation by designation means (an external unit and the like), and the control means (CPU 1 in the present embodiment) controls the drive of the sheet feed drive mechanism in response to the end of the counting by the timer 1-*b* so that the optimum loop is formed in the recording medium without being affected by the material of the recording medium and without damage.

There are provided the sheet feed drive mechanism, detection means (the pre-registration sensor 14) for detecting the leading edge of the recording medium fed from the sheet feed drive mechanism, second setting means for variably setting a feed time from the start of the feed in accordance with the sheet feed condition, a second timer (timer 1-*c*) for counting the feed time set by the second setting means, and discrimination means for determining the presence or absence of feed jam in accordance with the counting by the second timer and the output from the detection means.

Further, a plurality of sheet feed drive mechanisms and selection means (the CPU 1) for selecting the sheet feed port of the recording medium to be fed from the sheet feed drive mechanisms are provided so that the second setting means can variably set the feed time which is counted by the second timer (timer 1-*c*) in accordance with the selection of the sheet feed port by the selection means.

Designation means for designating the material of the recording medium fed from the selected sheet feed port is provided so that the second timer (timer 1-*c*) can variably set the feed time which is counted by the second timer (timer 1-*c*) in accordance with the designation of the material by the designation means.

Figure 2:
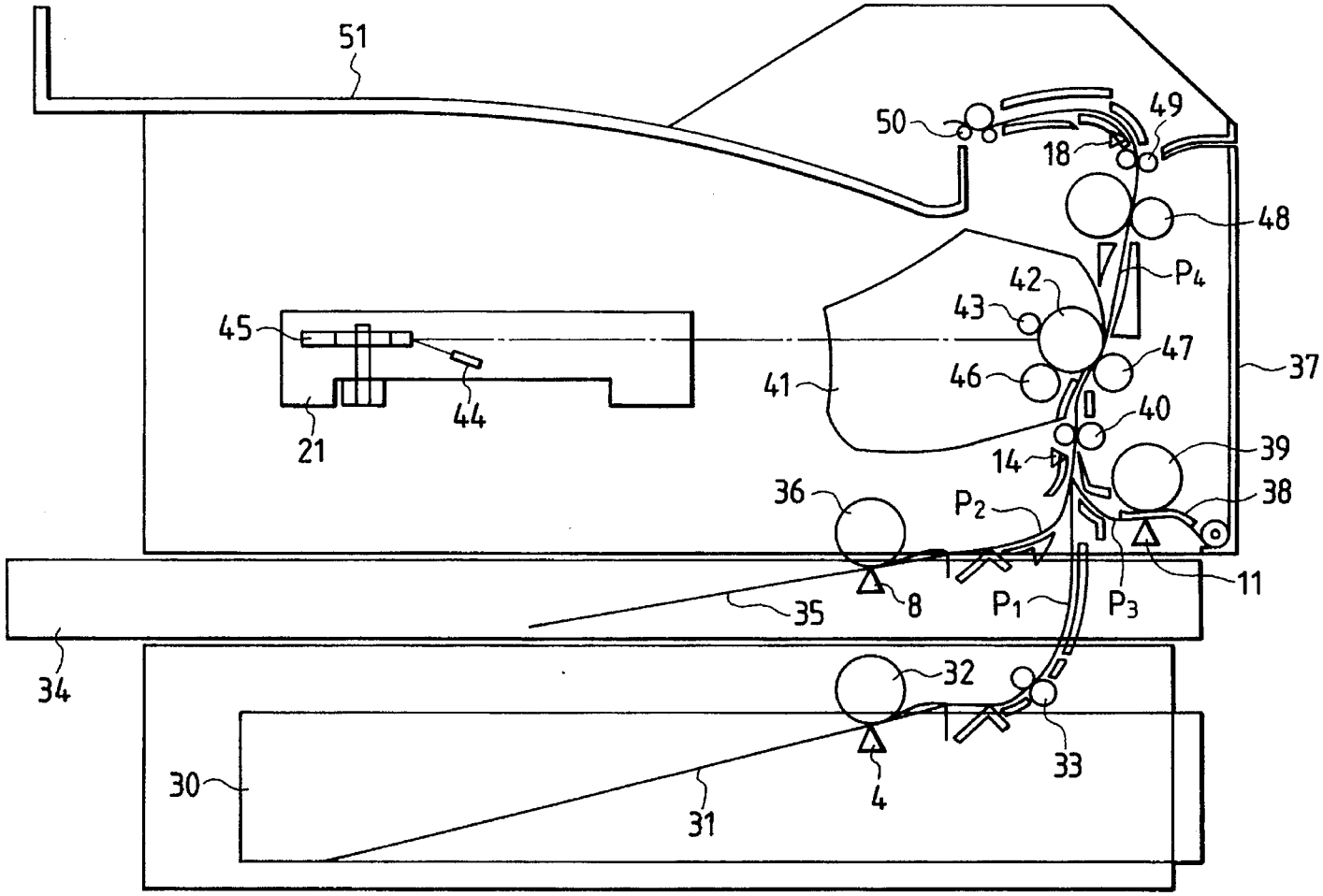
FIG. 2 shows a sectional view of a mechanical configuration of the recording apparatus shown in FIG. 1.

FIG. 2 shows a sectional view of a mechanical configuration of the recording apparatus shown in FIG. 1. The construction and operation thereof are described below.

In FIG. 2, numeral 30 denotes an optional cassette housed in an optional feeder. A recording sheet accommodated therein always abuts against an optional sheet (paper) feed roller 32 by a plate 31 lifted by a spring (not shown). When the clutch 5 is activated (turned on) while the main motor 19 is driven, the recording sheet is transported by the optional sheet feed roller 32, passes through a pair of optional feeder transport rollers 33 and is fed to the position of the pre-registration sensor 14 along a transport path $P_1$. A predetermined time after the detection of a leading edge of the recording sheet by the pre-registration sensor 14, the clutch 5 is deactivated (turned off). At this time, the recording sheet has the leading edge thereof abutted against the registration roller pair 40 with a predetermined amount of loop (flexure). Numeral 34 denotes a standard cassette loaded in the recording apparatus. A recording sheet accommodated therein also abuts against a standard cassette sheet feed roller 36 by a plate 35. When the recording sheet is fed from the standard cassette 34, it is transported along a transport path $P_2$ and has a leading edge thereof abutted against the registration roller pair 40 with a predetermined amount of loop. Numeral 37 denotes a front cover which may be opened to a generally horizontal position rightward in the drawing so that it functions as a multi-purpose tray (MPT). Numeral 38 denotes an MPT sheet feed plate which is in a down position except in a print mode, and in the print mode in which the presence of sheet (paper) is detected by the sheet sensor 11 and the MPT is designated as a sheet feed port, the MPT sheet feed plate is pressed by a sheet feed roller 39 as shown in FIG. 2 so that when the recording sheet is fed from the front cover 37 which functions as the MPT, the sheet is fed along a transport path $P_3$ and the leading edge thereof abuts against the registration roller pair 40 with a predetermined amount of flexure. In the recording apparatus of the present embodiment, the transport paths $P_1$–$P_3$ which serve as the transport paths to feed the recording sheets are provided, and the sheet feed mechanism for feeding the recording sheets to the transport paths $P_1$–$P_3$ is provided.

When the CPU 1 of the recording apparatus receives a vertical synchronous signal from an external unit, it first activates the registration roller clutch 15 to drive the registration roller pair 40 to transport the recording sheet along the transport path $P_4$.

A photoconductor drum 42 is provided in the cartridge 41 and it is rotated counterclockwise with respect to the plane of the drawing of FIG. 2. The photoconductor drum 42 is first uniformly charged by a primary charge roller 43 arranged therearound. Numeral 44 denotes a semiconductor laser which emits a laser beam which is modulated by an image signal sent from the external unit. The laser beam is irradiated to a polygon mirror 45 which is rotated at a controlled rotating speed so that it horizontally scans the photoconductor drum 42 to form a latent image. As the photoconductor drum 42 is rotated, the latent image is toner-developed by a development cylinder 46 and the developed image is transferred onto the recording sheet which is transported by a transfer roller 47. The recording sheet has the toner image fixed thereon by a fixing roller pair 48, passes through an ejection roller pair 49 and is ejected to an ejection tray 51 while the flexure is corrected by rollers 50.

FIG. 3 shows examples of communication commands for the CPU 1 shown in FIG. 1 and the external unit.

A code "4AH" corresponds to a command for feeding a recording sheet of the optional cassette 30 when the external unit feeds the sheet to the recording apparatus. A code "4CH" corresponds to a command to feed a recording sheet of the standard cassette 34. A code "4FH" corresponds to a command for feeding a recording sheet of the front cover 37 which functions as the multi-purpose tray. A code "9DH.XXH" corresponds to a command for designating a size and a type of a recording sheet to be fed from the front cover 37 which functions as the multi-purpose tray, to the recording apparatus from the external unit. The size is designated by XXH having a data configuration of 8 bits as shown in FIG. 4, in which six bits excluding a most significant bit (MSB) and a least significant bit (LSB) are used to designate the size and the type of the recording sheet.

Figure 5:
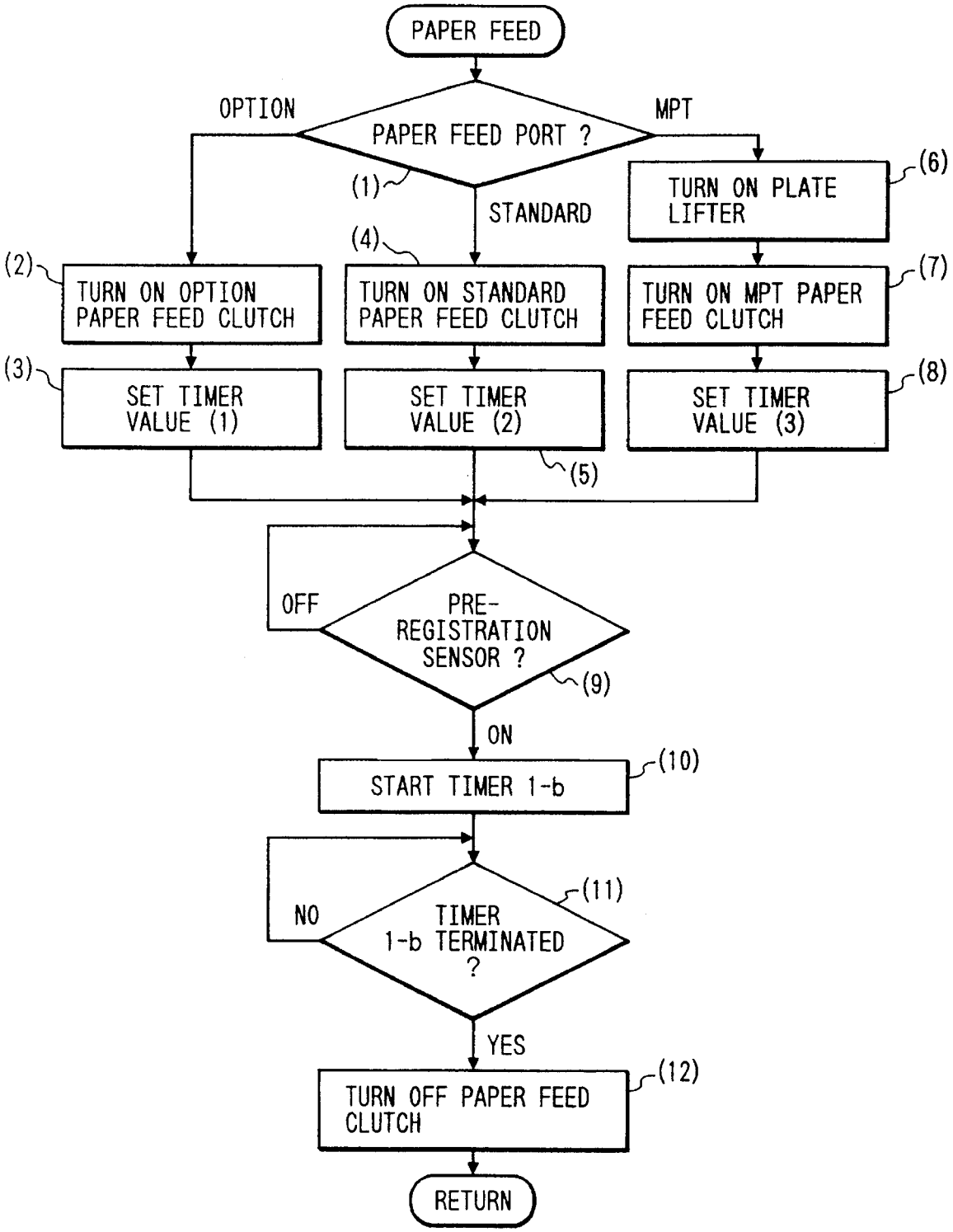
FIG. 5 shows a flow chart of a loop setting control process for a record sheet in the recording apparatus of the present invention.
Figure 6A:
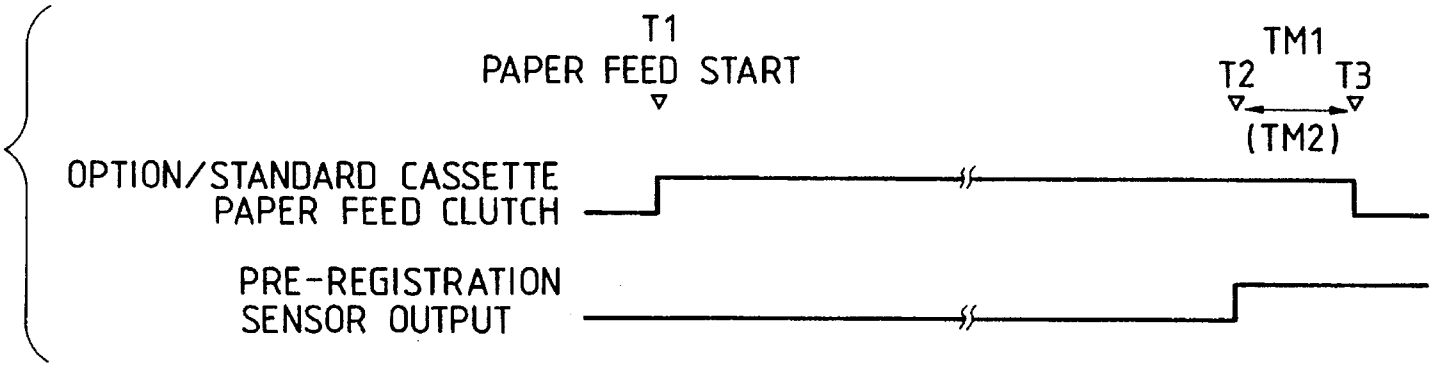
FIGS. 6A and 6B show timing charts for illustrating a timing of a loop setting control operation for the record sheet in the recording apparatus of the present invention.
Figure 6B:
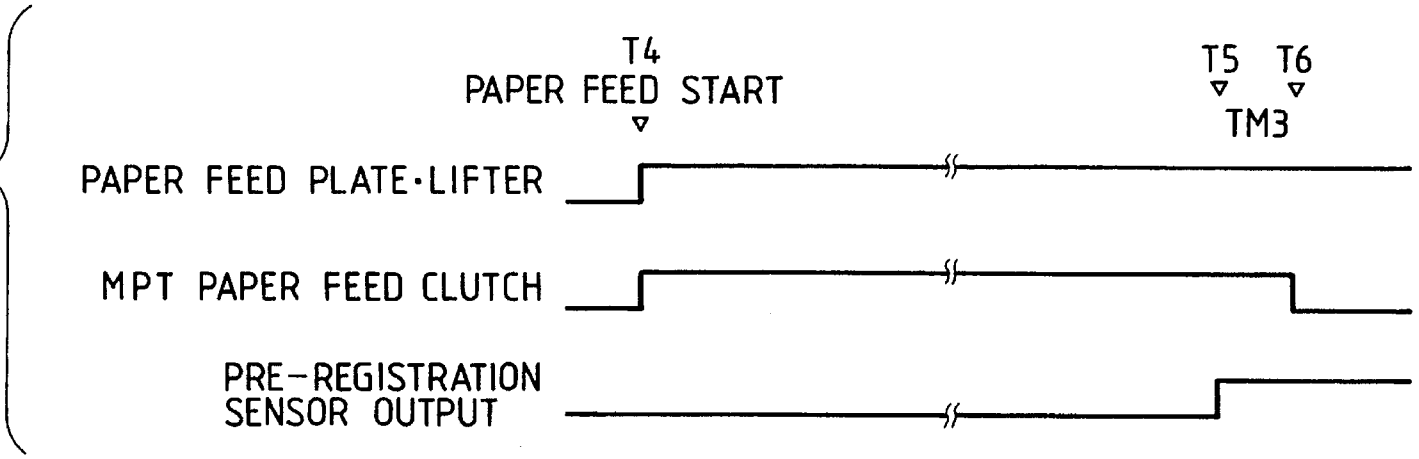

Referring to a flow chart shown in FIG. 5 and timing charts shown in FIGS. 6A and 6B, a loop formation control operation for the recording sheet in the recording apparatus of the present invention is described.

FIG. 5 shows a flow chart of a loop formation control sequence for the recording sheet in the recording apparatus of the present invention. Numerals (1)–(12) denote steps. A sheet feed port from which a sheet is to be fed next is stored in the RAM 1-*a*. The content of the RAM 1-*a* may be changed by an optional cassette sheet (paper) feed command, a standard cassette sheet (paper) feed command or a multi-purpose tray sheet (paper) feed command shown in FIG. 3.

When the sheet feed control is started, the designated sheet feed port is determined from the content of the RAM 1-*a* (step (1)) and if the sheet feed port is the optional cassette, the optional sheet feed clutch 5 is activated (step (2)), and a timer count value TM1 corresponding to a loop amount (flexure) 8 mm is set into the timer 1-*b*. The timer count TM1 corresponds to a time from a timing T2 (see FIG. 6A) at which the leading edge of the sheet is detected by the pre-registration sensor 14 while the sheet is fed from the optional cassette, to a timing T3 at which the clutch 5 for feeding the optional cassette sheet is deactivated.

On the other hand, if the sheet feed port is the standard cassette in the step (1), the standard cassette clutch 9 is activated (step (4)) and a timer count value TM2 corresponding to a loop amount (flexure) 8 mm is set into the timer 1-*b* (step (5)). The timer count TM2 corresponds to a time from a timing T2 (see FIG. 6A) at which the leading edge of the sheet is detected by the pre-registration sensor 14 to a timing T3 at which the standard cassette sheet feed clutch 9 is deactivated, when the sheet is fed from the standard cassette. Since the sheet feed speed of the standard cassette is slower than that of the optional cassette, the timer count TM2 is larger than the timer count TM1.

On the other hand, if the sheet feed port is the multi-purpose tray in the step (1), the plate lifter 13 is activated at a timing T4 shown in FIG. 6B (step (6)), the multi-purpose tray clutch 12 is activated (step (7)), and a timer count value TM3 corresponding to a loop amount (flexure) 6 mm which is smaller than the loop amount (flexure) 8 mm is set into the timer 1-*b*. The timer count TM3 corresponds to a time from a timing T5 (see FIG. 6B) at which the leading edge of the sheet is detected by the preregistration sensor 14 to a timing T6 at which the optional sheet feed clutch 5 is deactivated when the sheet is fed from the multi-purpose tray. Since the sheet feed speed of the MPT, is equal to that of the standard cassette, the time count TM3 is smaller than the time count TM2.

The particular recording sheet fed to the position of the pre-registration sensor 14 from the sheet feed port is determined (step (9)), and when the leading edge of the recording sheet is detected, the timer 1-*b* in which the timer count has been set is started (step (10)), and when the timer times out (step (11)), the sheet feed clutch which has been activated in the step (2), (4) or (7) is deactivated (step 12). Then, the process is terminated.

Figure 7:
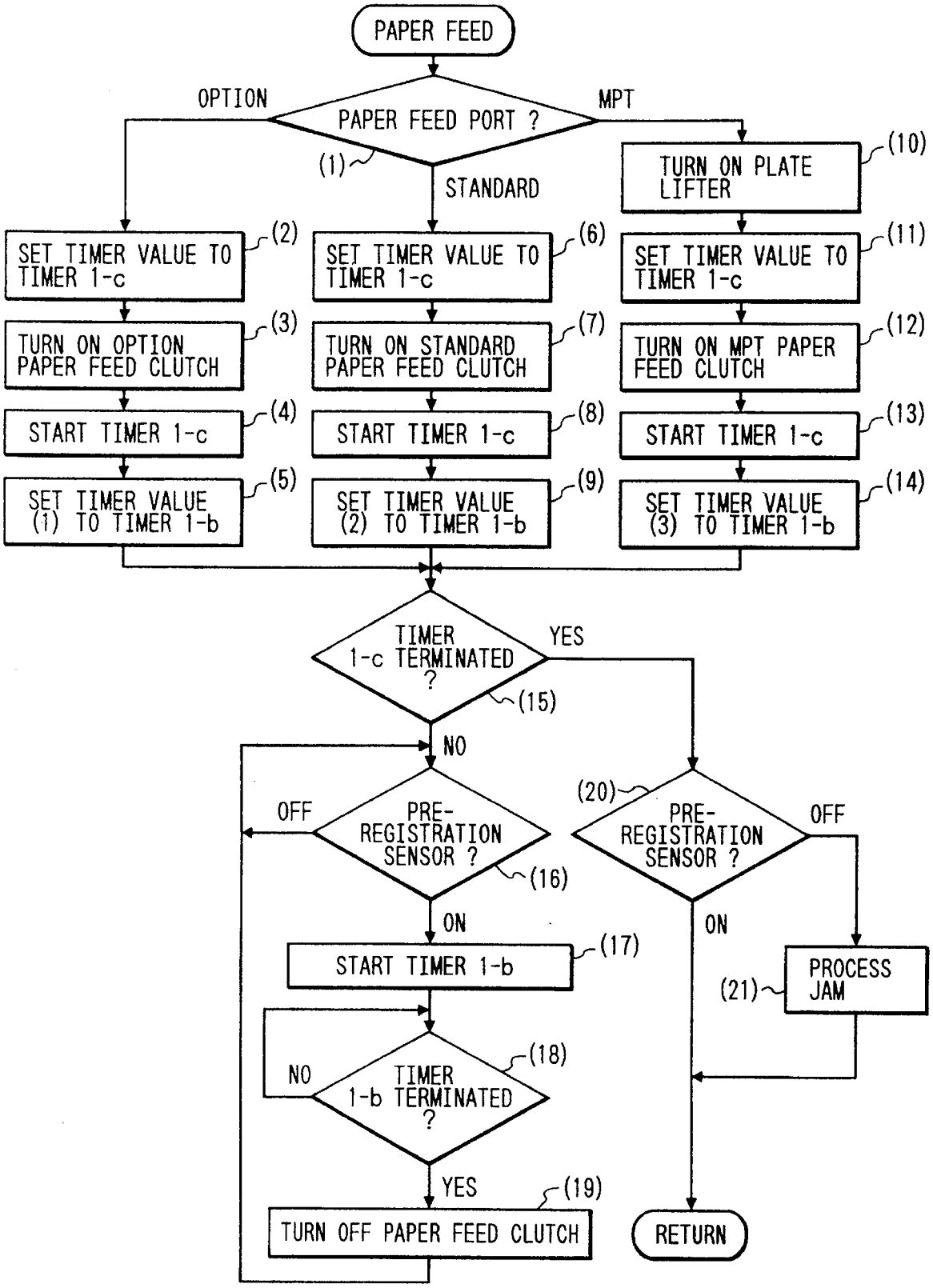
FIG. 7 shows a flow chart of the loop setting control process for the record sheet and a feed jam detection control process in the recording apparatus of the present invention.

Referring to a flow chart shown in FIG. 7 and timing charts shown in FIGS. 6A and 6B, the loop formation control for the recording sheet and a jam detection control operation in the recording apparatus of the present invention are described.

FIG. 7 shows a flow chart of a loop formation control for the recording sheet and jump detection control sequence in the recording apparatus of the present invention. Numerals (1)–(21) denote steps. A sheet feed port from which a recording sheet is to be fed next is stored in the RAM 1-*a*. The content of the RAM 1-*a* may be changed by the optional cassette sheet feed command (indication), the standard cassette sheet feed command (indication) or the multi-purpose sheet feed command (indication) shown in FIG. 3.

When the sheet feed control is started, the designated sheet feed port is determined from the content of the RAM 1-*a*, (step (1), and if the sheet feed port is the optional cassette 30, a timer count value TMN1 is set into the timer 1-C (step (2)). The timer count TMN1 corresponds to a time required for the sheet fed from the optional cassette 30 to reach the registration rollers 40 plus a loss time due to the variation in the transport path and the slip in the sheet feed roller 32 and the sheet transport roller 33, and a longest response time of the pre-registration sensor 14.

Then, the optional sheet feed clutch 5 is activated (step (3)) and the counting of the timer 1-*c* is started (step (4)), and a timer count value TM1 corresponding to the loop amount (flexure) 8 mm is set into the timer 1-*b* (step (5)). The timer count TM1 corresponds to a time from the timing T2 (see FIG. 6A) at which the leading edge of the sheet is detected by the pre-registration sensor 14 to the timing T3 at which the optional cassette sheet feed clutch 5 is deactivated when the sheet is fed from the optional cassette 30.

On the other hand, if the sheet feed port is the standard cassette in the step (1), a timer count value TMN2 is set into the timer 1-*c* (step (6)). The timer count TMN2 corresponds to the time required for the sheet fed by the standard cassette 34 to reach the registration roller 40 plus a loss time due to the variation in the transport path and the slip in the sheet feed roller 36 and a longest response time of the pre-registration sensor 14.

Then, the standard cassette clutch 9 is activated (step (7)), the counting by the timer 1-*c* is started (step (8)), and a timer count value TM2 corresponding to the loop amount (flexure) 8 mm is set into the timer 1-*b*. The timer count TM2 corresponds to a time from the timing T2 (see FIG. 6A) at which the leading edge of the sheet is detected by the pre-registration sensor 14 to the timing T3 at which the standard cassette sheet feed clutch 9 is deactivated when the sheet is fed from the standard cassette. Since the sheet feed speed of the standard cassette is slower than that of the optional cassette, the timer count TM2 is larger than the timer count TM1.

On the other hand, if the sheet feed port is the multi-purpose tray 37 in the step (1), the plate lifter 13 is activated at the timing TM4 shown in FIG. 6B (step (10)), and a timer count value TMN3 is set into the timer 1-*c* (step (11)). The timer count TMN3 corresponds to the time required for the sheet fed from the multi-purpose tray 37 to reach the registration roller 40 plus the variation in the transport path and the slip in the sheet feed roller 39 and the longest response time of the pre-registration sensor 14.

Then, the multi-purpose tray clutch 12 is activated (step (12)), the counting of the timer 1-*c* is started (step (13)) and the timer count TM3 corresponding to the loop amount (flexure) 6 mm which is smaller than the loop amount (flexure) 8 mm is set into the timer 1-*b* (step (14)). The timer count TM3 corresponds to a time from a timing T5 (see FIG. 6B) at which the leading edge of the sheet is detected by the pre-registration sensor 14 to a timing T6 at which the optional sheet feed clutch 5 is deactivated when the sheet is fed from the multi-purpose tray. Since the sheet feed speed of the MPT is equal to that of the standard cassette, the timer count TM3 is smaller than the timer count TM2.

Then, the time-out of the timer 1-*c* is determined (step (15)). If it is not timed out yet, whether any sheet fed from the sheet feed port has reached the position of the pre-registration sensor 14 or not is determined (step (16)), and if the leading edge of the record sheet is detected, the timer 1-*b* to which the count has been set is started (step (17)) . When the timer is timed out (step (18)), the sheet feed clutch which has been activated in the step (3), (7) or (12) is deactivated (step (19)). Then, the process returns to the step (15).

On the other hand, if the decision in the step (15) is YES, whether the sheet has reached the pre-registration sensor 14 or not is determined (step (20)), and if the sheet has not reached, a jam decision is made and a jam process to stop the print operation of the apparatus is executed (step (21)) and the process is terminated. If the sheet has reached, the process gets out of the sheet feed program.

Figure 8A:
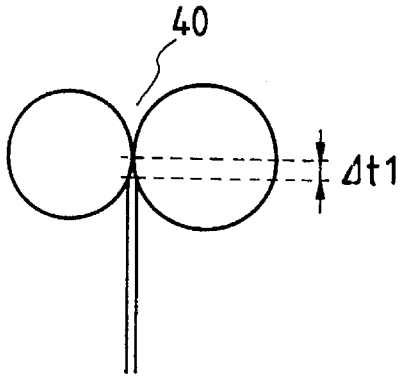
FIGS. 8A and 8B show sectional views for illustrating the abutment of the record sheet against a pair of registration rollers shown in FIG. 2.
Figure 8B:
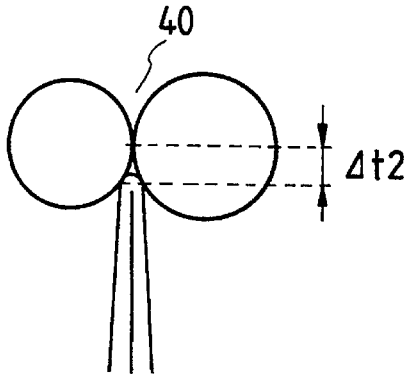

In the present embodiment, the loop amount to be formed in the second sheet fed from the sheet feed port and the sheet feed jam detection timer count are switched. The types of the second sheets to be fed from the multi-purpose tray include ordinary sheets, post cards and envelopes and the thicknesses thereof vary widely. Thus, as shown in FIGS. 8A and 8B, the abutment state of the record sheet to the registration roller pair 40, that is, non-arrival distances $\Delta t1$, $\Delta t2$ increase as the thickness increases. Further, the slip in the sheet feed roller 39 increases and the variation in the time required to reach the registration roller pair 40 increases so that the normal sheet feed may be erroneously determined as a jam if the timer counts TMN1–TMN3 set for the ordinary sheet are used.

FIG. 8A shows an abutment state to the registration roller 40 when the record sheet is an ordinary sheet, and FIG. 8B shows an abutment state to the registration roller 40 when the record sheet is an envelope. Since the post card and the envelope are to be used for mailing, they are generally tough and may be flexed in snake shape if the same loop amount as that for the ordinary sheet is used.

More specifically, if the multi-purpose tray is determined in the step (1) of the flow chart shown in FIG. 5, the loop amount is controlled in accordance with the sheet size and type designated by the MPT sheet size and type designation command. Namely, whether the record sheet is an ordinary sheet, or a post card or an envelope is determined based on the sheet size code, and if it is the former, the timer count corresponding to the loop amount 6 mm is set into the timer 1-*b*, and if it is the latter, the timer count corresponding to the loop amount 3 mm is set. In this manner, the snake bending of the post card or envelope is avoided by controlling the loop amount. Assuming that the timer counts TMN1–TMN3 for the jam detection include the arrival delay of 20 mm for the ordinary sheet, the timer count TMN3 (for the MPT sheet feed) corresponding to the delay of 40 mm–60 mm which is 2–3 times larger than that for the ordinary sheet is to be set for the post card and the envelope.

In the present embodiment, the loop amount of the record sheet is changed in accordance with the type of the record sheet fed from the sheet feed port and the particular sheet feed port. Even the ordinary record sheets of the same size, the thicknesses thereof may vary from country to country. Since the difference in the thicknesses is reflected to the non-arrival distance to the registration roller 40 shown in FIGS. 8A and 8B, the thickness of the record sheet may be specified by shipment destination of the recording apparatus to prevent the misregistration due to the difference in the thicknesses of the record sheets of different shipment destinations.

Figure 9:
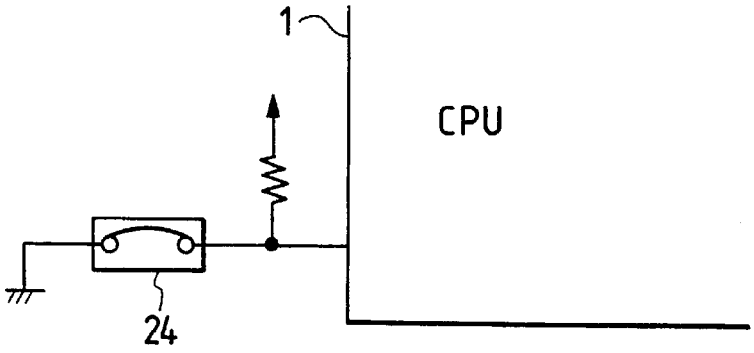
FIG. 9 shows a circuit block diagram of a loop designation circuit of the recording apparatus in accordance with another embodiment of the present invention.

Specifically, as shown in FIG. 9, a jumper wire 24 for designating the thickness of the record sheet is provided, and a break state of the jumper wire 24 is informed to the CPU 1. If the jumper wire 24 is in the break state, it is determined that the sheet is thick and the loop amount to be set in the cassette sheet feed in the step (1) is set to 7 mm. If the jumper wire 24 is connected, it is determined that the sheet is thin and the loop amount is set to 8 mm. In this manner, a problem which may otherwise be raised by the difference of the shipment destinations is solved. In addition, the jam detection timer counts TMN1–TMN3 are also set to the sheet arrival delay of 40 mm if the jumper wire 24 is in the break state, and set to the sheet delay of 20 mm if the jumper line 24 is connected.

Figure 10B:
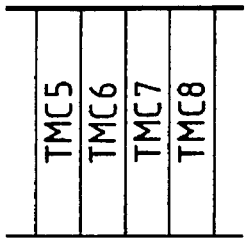
FIGS. 10A and 10B show data tables for determining the end of a record sequence in the recording apparatus of the present invention.
Figure 10A:
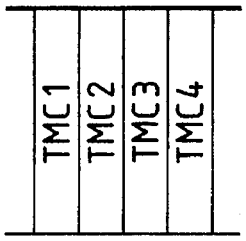
Figure 11:
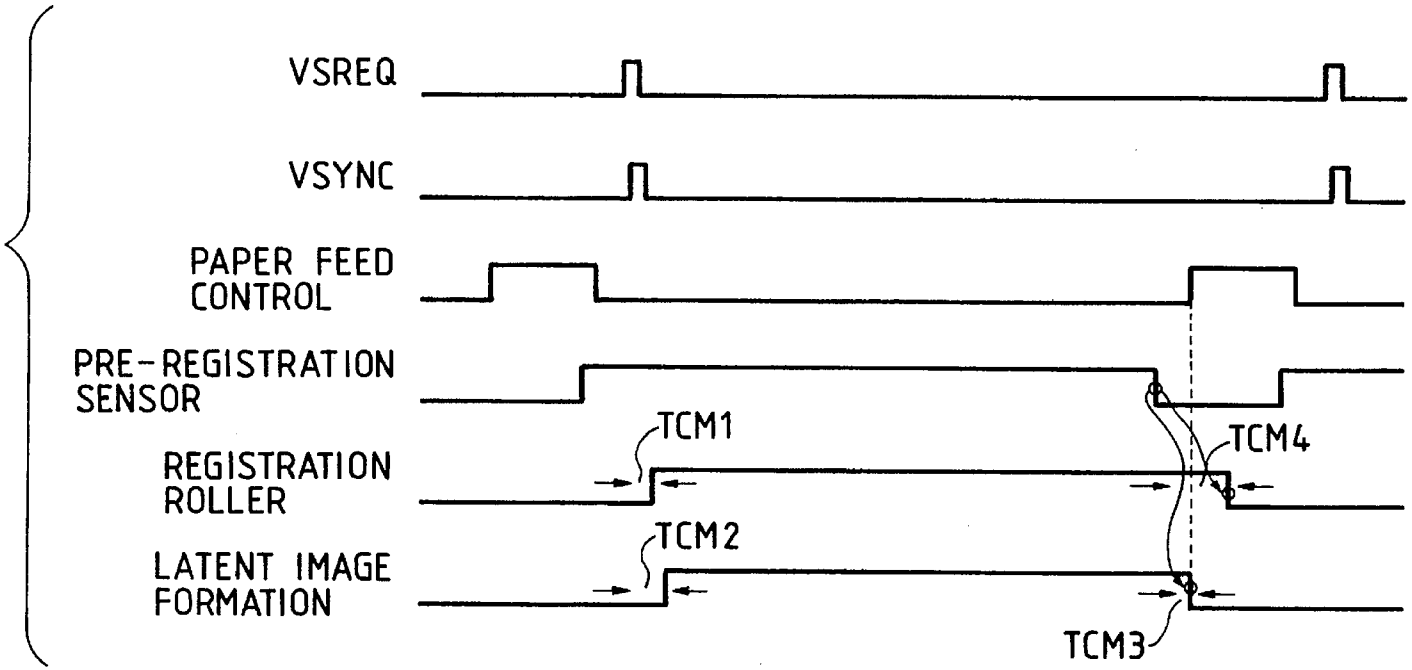
FIG. 11 shows a timing chart for illustrating the record sequence in the recording apparatus of the present invention.
Figure 12:
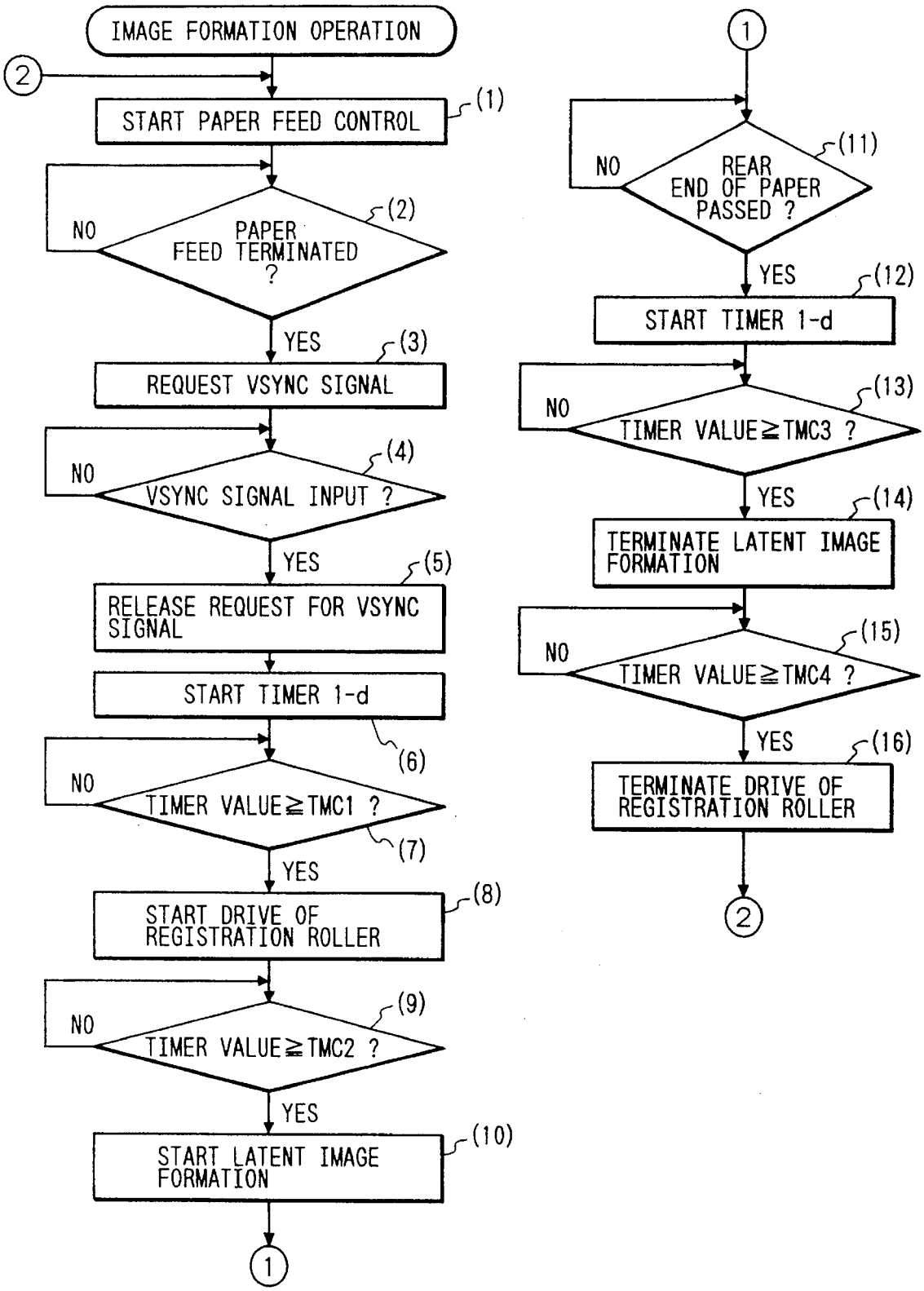
FIG. 12 shows a flow chart of a record sequence end timing control process in the recording apparatus of the present invention.

Referring now to FIGS. 10 to 12, a record sequence termination timing control operation in the recording apparatus of the present invention is described.

Specifically, in the printing apparatus shown in FIG. 1, when the passage of the recording medium fed from the sheet feed drive mechanism through a predetermined point is detected by the detection means (pre-registration sensor 14), a third timer 1-*d* starts to count an elapse time from the predetermined position passage, and the termination control means (CPU 1) controls the record sequence termination timing in accordance with the counting of the third timer so that the record sequence may be terminated at an optimum timing without being influenced by the transport length of the recording medium and without imparting a load or a damage to the image recording system or the recording medium drive system.

When the passage of the recording medium fed from the sheet feed drive mechanism through the predetermined point is detected by the detection means (the pre-registration sensor 14 and the ejection unit sensor 18), the third timer 1-*d* starts to count the elapse time from the predetermined point passage, and the sheet ejection control means (CPU 1) controls the automatic sheet ejection sequence of the recording medium in accordance with the counting of the third timer so that the ejection of the staying recording medium is completed at an optimum timing without being influenced by the transport length of the recording medium, and the automatic ejection jam detection is attained.

FIG. 10 shows a data table for determining the termination of the record sequence in the recording apparatus of the present invention. It is stored in the ROM of the CPU 1 shown in FIG. 1.

As shown, timer counts TMC1–TMC8 to be counted by the timer 1-*d* shown in FIG. 1 are stored in the ROM. The values of the timer counts TMC1–TMC8 will be described later.

FIG. 11 shows a timing chart for illustrating a record sequence in the recording apparatus of the present invention.

FIG. 12 shows a flow chart of a record sequence termination timing control process in the recording apparatus of the present invention. Numerals (1)–(16) designate steps.

The sheet feed control described above is first started (step (1)), and when the sheet feed control is terminated (step (2)), a vertical synchronization request signal for requesting a vertical synchronous signal is sent to the external unit at a timing shown in FIG. 10 (step (3)). When the vertical synchronous signal is supplied from the external unit (step (4)), the vertical synchronization request signal is released (step (5)). Instantly, the timer 1-*d* is started from "0". The timer 1-*d* is sequentially counted up and when the count of the timer 1-*d* reaches TMC1 (step (7)), the registration clutch 15 is activated so that the drive of the registration roller pair 40 is started (step (8)). When the count of the timer 1-*d* reaches TCM2 (step (9)), the formation of a latent image is started (step (10)). The latent image is formed by the rotation control to the photoconductor drum 42, the control of the high voltage circuit block 16, the laser 44 in the laser unit 21 and the rotation control of the polygon mirror 45.

Then, the passage of the print sheet is checked by the pre-registration sensor 14 (step (11)), and when the trailing or rear edge of the sheet passes through the detection point of the pre-registration sensor 14, the timer 1-*d* is restarted from "0" (step (12)). When the count of the timer 1-*d* reaches TMC3 (step (13)), the formation of the latent image is terminated (step (14)), and when the count of the timer 1-*d* reaches TCM4 (step (15)), the registration roller clutch 15 is deactivated and the drive of the registration roller pair 40 is terminated (step (16)). In the present embodiment, the timer count TMC3 corresponds to a time from the sheet trailing edge detection timing by the pre-registration sensor 14 to the timing of the formation of the latent image at the position on the photoconductor drum 42 corresponding to the position which is offset by 2 mm of a margin from the trailing edge of the sheet. The timer count TMC4 corresponds to a time from the sheet trailing edge detection timing by the pre-registration sensor 14 to a timing at which the trailing edge of the sheet is fed 2 mm more after the passage through the registration roller pair 40.

The automatic sheet ejection control operation for the staying recording medium in the recording apparatus of the present invention is now described.

Figure 13:
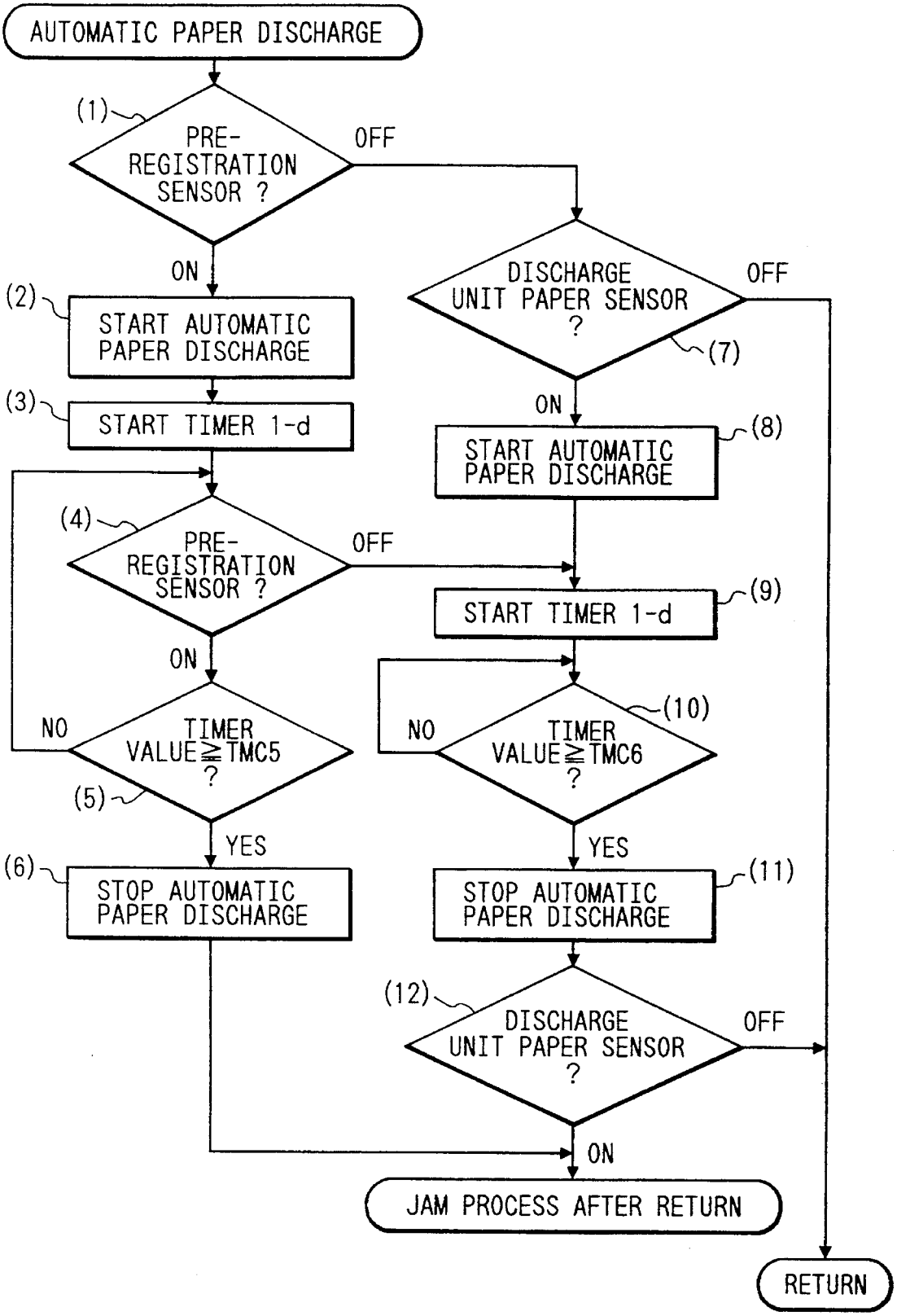
FIG. 13 shows a flow chart of a first automatic sheet ejection control process for the recording medium staying in the recording apparatus of the present invention.

FIG. 13 shows a flow chart of a first automatic sheet ejection control process for the staying recording medium in the recording apparatus of the present invention. Numerals (1)–(12) denote steps, which are started immediately after the recording apparatus is powered on to eject the recording medium (sheet) which stays in the apparatus when the apparatus is powered on out of the apparatus. This is hereinafter called the automatic sheet ejection process.

The presence or absence of the sheet is first detected by the pre-registration sensor 14 (step (1)), and if the pre-registration sensor 14 detects the presence, the automatic sheet ejection is started on the transport path which includes the position of the pre-registration sensor 14 (step (2)). The automatic sheet ejection is conducted by driving the main motor 19 and activating the registration roller clutch 15 to drive the registration roller pair 40. Simultaneously with the start of the automatic sheet ejection, the timer 1-*d* is started from "0" (step (3)). During the automatic sheet ejection started in the step (2), the passage of the sheet is continuously monitored by the pre-registration sensor 14 (step (4)), and if it passes through, that is, if the trailing edge of the sheet is detected by the pre-registration sensor 14, the process proceeds to a step (9). If the trailing edge of the sheet does not pass before the count of the timer 1-*d* reaches TMC5 (step (5)), the automatic sheet ejection is stopped (step (6)), and the occurrence of jam is determined. In the present embodiment, the timer count TMC5 corresponds to a time from the start of the transport of the sheet having a length of 432 mm having the leading edge thereof abut against the registration roller pair 40, by the drive of the registration roller pair 40 to a timing at which the trailing edge of the sheet is fed 30 mm more after the passage through the point of detection of the presence or absence by the pre-registration sensor 14.

If the sheet is not detected in the step (1), the sheet is also detected by the sheet ejection sensor 18 (step (7)). If the presence of the sheet is detected, the automatic sheet ejection process is started (step (8)), and the timer 1-*d* is started from "0". If the process proceeds to the step (9) in the step (4), the timer 1-*d* is also started from "0".

Then, the arrival of the count of the timer 1-*d* to the timer count TMC6 is monitored (step (10)). In the present embodiment, the timer count TMC6 corresponds to a time from the detection of the passage of the trailing edge of the automatically ejected sheet through the pre-registration sensor 14 to the passage of the position of the rollers 50 shown in FIG. 2.

When the count of the timer 1-*d* reaches the timer count TMC6, the automatic sheet ejection process is stopped (step (11)). The presence or absence of the sheet is detected by the sheet ejection unit sensor 18 (step (12)), and if the presence of the sheet is detected, a jam state is determined, and if the absence of the sheet is detected, the process is returned to shift to other process. The process is also returned when both the pre-registration sensor 14 and the sheet ejection unit sensor 18 do not detect the sheet in the steps (1) and (7).

In the flow shown in FIG. 13, the sheet ejection unit sensor 18 detects the sheet ejection unit jam by the presence or absence of the sheet at the sheet ejection unit sensor 18 after the elapse of the timer count TMC6 by the timer 1-*d*. Depending on the transport status, the sheet may stay at the rollers 50 shown in FIG. 1 at the elapse of the timer count TMC6 after the sheet ejection sensor 18 has detected the trailing edge of the sheet.

Figure 14:
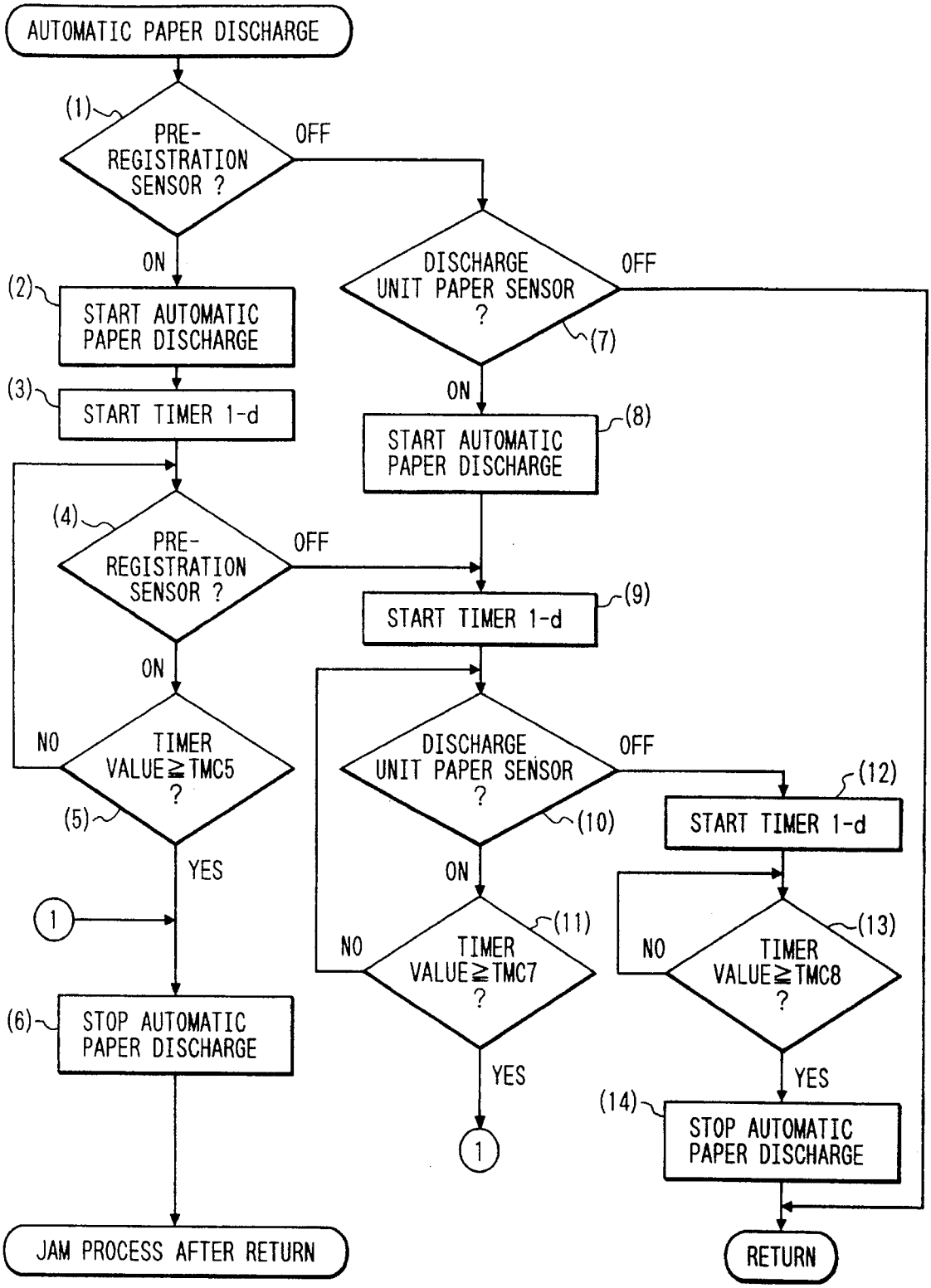
FIG. 14 shows a flow chart of a second automatic sheet feed control process for the recording medium staying in the recording apparatus of the present invention.
Figure 15:
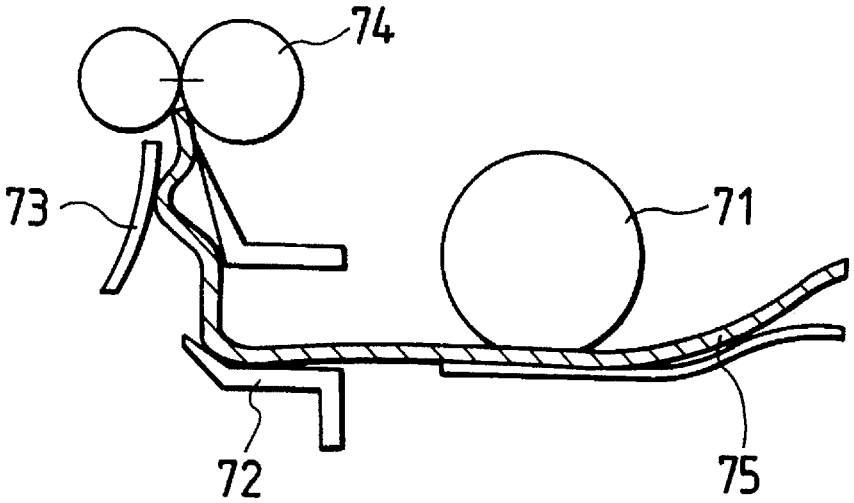
FIG. 15 shows a sectional view of a sheet feed mechanism of the recording apparatus of the present invention.

This problem may be solved by modifying the step (9) shown in FIG. 13, as shown in FIG. 14.

FIG. 14 shows a flow chart of a second automatic sheet ejection control process for the staying recording medium in the recording apparatus of the present invention. Numerals (1)–(14) denote steps, which are started immediately after the recording apparatus is powered on to eject the recording medium (sheet) staying in the apparatus when it is powered on, out of the apparatus. This is hereinafter referred to as the automatic sheet ejection process. The steps (1)–(8) are similar to those of FIG. 13 and the explanation thereof is omitted.

In a step (9), the timer 1-*d* is started. If the timer count reaches TMC7 (step (11)) during the detection of the sheet by the sheet ejection unit sensor 18, the process proceeds to the step (6) and the occurrence of jam is determined.

In the present embodiment, the timer count TMC7 corresponds to a time from the detection of the trailing edge of the automatically ejected sheet through the pre-registration sensor 14 in the step (2) to a timing at which it is fed 30 mm more after the passage through the sheet ejection unit sensor 18 has been detected.

On the other hand, if the passage of the trailing edge of the sheet is detected by the sheet ejection unit sensor 18 before the count of the timer 1-*d* reaches the timer count TMC7, the timer 1-*d* is restarted (step (12)), and when the count reaches the timer count TMC8 (step (13)), the automatic sheet ejection process is terminated (step (14)).

In the present embodiment, the timer count TMC8 corresponds to a time from the passage of the trailing edge of the sheet through the detection position of the sheet ejection unit sensor 18 to the passage through the rollers 50.

In the present embodiment, the automatic sheet ejection process after the power-on has been described. By executing the sheet ejection unit stay jam detection process during the print operation, a timing to detect the stay jam at the exit of the transport path can be readily set. When the length of the print sheet is known, the sheet ejection unit stay jam detection timer may be started at the detection of the leading edge of the sheet through the sheet ejection unit sensor 18 during the print operation. In this case, the timer count corresponds to a time required to transport the sheet by the length of the sheet plus margin (for example, 30 mm).

The present invention is not limited to the above embodiments but various modifications thereof may be made without departing from the scope of the claims.

What is claimed is:

1. A sheet feeding apparatus comprising:

transport rollers for transporting a sheet;

means for driving said transport rollers;

registration rollers for registrating the sheet transported by the transport rollers;

detection means, provided between the transport rollers and the registration rollers, for detecting the sheet; and control means for controlling the drive of said transport rollers in accordance with the detection of the sheet by the detecting means in a plurality of control modes, a flexure of the sheet between said transport rollers and said registration rollers being different in each of the control modes.

2. A sheet feeding apparatus according to claim 1, further comprising means for determining that the sheet is jamming when said detection means does not detect the sheet after elapse of a predetermined time after start of the drive of said transport rollers.

3. A sheet feeding apparatus according to claim 2, further comprising means for forming an image on an image bearing member and transfer means for transferring the image formed on the image bearing member to the sheet transported by said registration rollers.

4. A sheet feeding apparatus according to claim 3, further comprising determining means for determining a completion timing of an image forming operation on the basis of detection of a trailing edge of the sheet by said detecting means.

5. A sheet feeding apparatus according to claim 3, further comprising means for discharging the sheet to which the image is transferred and discharge control means for controlling an operation timing of said discharge means on the basis of said detecting means.

6. An apparatus according to claim 3, wherein said apparatus makes image formation onto the image bearing member in synchronism with the transportation of the sheet by said registration rollers.

7. A sheet apparatus according to claim 1, further comprising means for inputting information relating to a sheet type, wherein said control means selects the control mode in accordance with input information.

8. A sheet apparatus according to claim 1, further comprising a plurality of sheet feeding means for feeding the sheet to said transport rollers, wherein said control means selects the control mode corresponding to each of said sheet feeding means.

9. An apparatus according to claim 1, wherein the control mode is selected in accordance with a material of the sheet.

10. An apparatus according to claim 9, further comprising means for inputting a designation of the material of the sheet.

11. An apparatus according to claim 1, wherein said apparatus has a plurality of sets of transport rollers, and the control mode is selected in accordance with the transport rollers by which the sheet is transported.

12. An apparatus according to claim 1, wherein after the sheet is detected by said detection means in accordance with the control mode, the time when the drive of said transport rollers is stopped is different.

13. An apparatus comprising:

a sheet feed mechanism;

detection means for detecting at a predetermined position a sheet fed from said sheet feed mechanism;

means for registrating the sheet fed by said sheet feed mechanism; and control means for controlling the drive of said sheet feed mechanism in accordance with an output of said detection means in one of a plurality of control modes, a loop amount of a sheet between said sheet feed mechanism and said registrating means in each of the control modes being different.

14. An apparatus according to claim 13, wherein said control means renders driving time of said sheet feed mechanism after detection of said sheet by said detection means different in accordance with the control mode.

15. An apparatus according to claim 13, further comprising means for selecting the control mode in accordance with a material of the sheet.

16. An apparatus according to claim 13, further comprising at least one sheet feed mechanisms and a selection means for selecting one of said sheet feed mechanisms, wherein said control means determines the loop amount to be formed by the sheet in accordance with the sheet feed mechanism selected by said selection means.

17. An apparatus according to claim 13, further comprising designation means for designating a material of the recording medium, wherein said control means determines the loop amount to be formed by the sheet in accordance with the material designation by said designation means.

18. An apparatus according to claim 13, further comprising means for recording an image on the fed sheet.

19. An apparatus according to claim 18, wherein said recording means comprises means for forming the image on an image bearing member and means for transferring the image formed on the bearing member.

20. An apparatus according to claim 18, wherein said recording means records the image on the sheet using an electrographic method.

21. An apparatus according to claim 18, wherein said registrating means conveys the registered sheet to said recording means.

22. An apparatus according to claim 21, wherein said apparatus makes the recording by said recording means in synchronism with the conveyance of the sheet by said registrating means.

23. A recording apparatus comprising:

a sheet feed drive mechanism;

detection means for detecting at a predetermined position a recording medium fed from said sheet feed drive mechanism;

a timer for counting a loop feed time for defining a loop amount formed by said recording medium in accordance with an output state of said detection means;

setting means for variably setting the loop feed time to be counted by said timer;

control means for controlling the drive of said sheet feed drive mechanism by terminating a feeding operation in accordance with the counting by said timer; and designation means for designating a material of the recording medium, said setting means variably setting the loop feed time in accordance with the material designation by said designation means.

24. A recording apparatus comprising:

a sheet feed drive mechanism;

detection means for detecting at a predetermined position a recording medium fed from said sheet feed drive mechanism;

a timer for counting a loop feed time for defining a loop amount formed by said recording medium in accordance with an output state of said detection means;

setting means for variably setting the loop feed time to be counted by said timer;

control means for controlling the drive of said sheet feed drive mechanism by terminating a feeding operation in accordance with the counting by said timer; and a plurality of sheet feed drive mechanisms and a selection means for selecting one of said sheet feed drive mechanisms, wherein said setting means variably sets the loop feed time in accordance with the sheet feed drive mechanism selected by said selection means.

25. A recording apparatus according to claim 24, further comprising:

second setting means for variably setting a feed elapse time from a start of feeding from said sheet feed drive mechanism;

a second timer for counting the feed elapse time set by said second setting means; and discrimination means for determining the presence or absence of feed jam in accordance with the counting of said second timer and the output state of said detection means.

26. A recording apparatus according to claim 25, further comprising a plurality of sheet feed drive mechanisms and a selection means for selecting one of said sheet feed drive mechanisms, wherein said second setting means variably sets the feed elapse time in accordance with the sheet feed drive mechanism selected by said selection means.

27. A recording apparatus according to claim 25, further comprising designation means for designating a material of the recording medium, said second setting means variably setting the feed elapse time in accordance with the material designation by said designation means.

28. A recording apparatus according to claim 25, further comprising:

a third timer for counting an elapsed time from the passage of the recording medium through said predetermined position in accordance with the detection by said detection means; and termination control means for controlling a record sequence termination timing in accordance with the counting of said third timer.

29. A recording apparatus according to claim 25, further comprising:

a third timer for counting an elapsed time from the passage through said predetermined position in accordance with the detection by said detection means; and sheet ejection control means for controlling an automatic sheet ejection sequence for the recording medium in accordance with the counting of said third timer.

30. A method of feeding sheets with a sheet feed mechanism comprising the steps of:

selecting one of a plurality of control modes;

detecting a sheet fed from the sheet feed mechanism at a position between the sheet feed mechanism and registration means downstream of said sheet feed mechanism; and controlling the drive of the sheet feed mechanism in accordance with said detection, a loop amount of a sheet between the sheet feed mechanism and the registration means in each of the control modes being different.

31. A method according to claim 30, wherein the driving time of the sheet feed mechanism after detection of the sheet differs in accordance with the control mode.

32. A method according to claim 30, wherein in the selecting step, the control mode is selected in accordance with a material of the sheet.

33. A method according to claim 30, wherein a plurality of sheet feed mechanisms are provided and the plurality of control modes correspond to the plurality of sheet feed mechanisms, respectively.

34. A method according to claim 30, further comprising the steps of designating a material of the recording medium, and determining the loop amount to be formed by the sheet in accordance with the material designation.

35. A method according to claim 30, further comprising the step of recording the image on the fed sheet.

36. A method according to claim 35, wherein said recording step comprises the steps of forming the image on an image bearing member and transferring the image formed on the image bearing member.

37. A method according to claim 35, wherein in said recording step, the image is recorded on the sheet using an electrographic method.

38. A method according to claim 35, further comprising the step of conveying the sheet registrated by said registration means for recording.

39. A method according to claim 38, wherein said recording step is made in synchronism with said conveying step in which the sheet is conveyed by said registration means.

40. A sheet feeding method comprising:

detecting at a predetermined position a recording medium fed from a sheet feed drive mechanism;

variably setting a loop feed time to be counted;

counting the loop feed time for defining a loop amount formed by said recording medium in accordance with an output of the detection;

controlling the drive of the sheet feed drive mechanism by terminating a feeding operation in accordance with the counting of the loop feed time;

variably setting a feed elapse time from a start of feeding from the sheet feed drive mechanism;

counting the feed elapse time set; and determining the presence or absence of a feed jam in accordance with the counting of the feed elapse time and the output state of the detection.

41. A sheet feeding method according to claim 40, further comprising the step of selecting one of a plurality of feed drive mechanisms, wherein the feed elapse time is variably set in accordance with the selected sheet feed drive mechanism.

42. A sheet feeding method according to claim 40, further comprising the step of designating a material of the recording medium, wherein the feed elapse time is variably set in accordance with the material designation.

43. A sheet feeding method according to claim 40, further comprising the steps of:

counting an elapsed time from the passage of the recording medium through the predetermined position in accordance with the detection at the predetermined position; and controlling a record sequence termination timing in accordance with the elapsed time.

44. A sheet feeding method according to claim 40, further comprising the steps of:

counting an elapsed time from the passage through the predetermined position in accordance with the detection at the predetermined position; and controlling an automatic sheet ejection sequence for the recording medium in accordance with the counting of the elapsed time.

* * * * *

UNITED STATES PATENT AND TRADEMARK OFFICE

CERTIFICATE OF CORRECTION

PATENT NO. : 5,612,776
DATED : March 18, 1997
INVENTOR(S) : Hitoshi MACHINO, et al.

It is certified that error appears in the above-indentified patent and that said Letters Patent is hereby corrected as shown below:

On title page,
AT [54] TITLE

"LOOP" should read --LOOP AMOUNT--.

COLUMN 1

Line 3, "LOOP" should read --LOOP AMOUNT--.

COLUMN 14

Line 5, "with" should read --with the--.

Signed and Sealed this

Ninth Day of September, 1997

*Attest:*

Bruce Lehman

BRUCE LEHMAN

*Attesting Officer*

*Commissioner of Patents and Trademarks*